United States Patent [19]

Cho

[11] Patent Number: 4,866,335

[45] Date of Patent: Sep. 12, 1989

[54] CRT ELECTRON GUN WITH MULTI-LENS SYSTEM

[75] Inventor: Seog-Lae Cho, Suwon, Rep. of Korea

[73] Assignee: Samsung Electron Devices Co., Ltd., Kyonggi, Rep. of Korea

[21] Appl. No.: 132,974

[22] Filed: Dec. 15, 1987

[30] Foreign Application Priority Data

May 26, 1987 [KR] Rep. of Korea ..... 87-5222

[51] Int. Cl.[4] ..... H01J 29/51'29/62

[52] U.S. Cl. ..... 313/412; 313/414

[58] Field of Search ..... 313/414, 412

[56] References Cited

U.S. PATENT DOCUMENTS 4,052,643 10/1977 Yamazaki et al. ..... 313/414 X

FOREIGN PATENT DOCUMENTS 0068848 4/1983 Japan ..... 313/414

0082448 5/1983 Japan ..... 313/414

*Primary Examiner*—Palmer C. DeMeo

*Attorney, Agent, or Firm*—Handal & Morofsky

[57] ABSTRACT

An electron gun for CRTs comprising multi-lens system is disclosed, wherein the rear part of the third electrode (16) forming the lens radius D3 is deeply recessed axialwise by interval H1 to provide the longer lens radius D3' equaling the lens radius D4 the fourth electrode (18) and the sixth electrode (22) is positioned inside the fifth electrode (20), thereby providing the main lens system forming the regions in the form of divergence-convergence-divergence-convergence-divergence-convergence- divergence, said sixth electrode (22) forming the subordinate lens against the main lens formed between the fifth electrode (20) and the seventh electrode (24), said interval H1 being limited within 0.5 to 0.54 of the lens radius D4of the fourth electrode.

5 Claims, 4 Drawing Sheets

CRT ELECTRON GUN WITH MULTI-LENS SYSTEM

BACKGROUND OF THE INVENTION

This invention relates to electron guns for color cathode ray tubes (CRT).

As is well-known, the resolution of a CRT bears a close relation to the diameter of the electron beam at the luminescent screen, which diameter is recognized as giving better resolution when it is the smaller.

The diameter of an electron beam is significantly influenced by the focusing characteristics of the generating electron gun, and therefore, efforts at improvement of the performance of an electron gun have been conventionally carried out by concentrating on the improvement of focusing characteristics.

Focusing charactersistics can be improved chiefly by improving the performance of the main focusing lens system and the subordinate lens system.

The focusing lens systems of the electron guns known in the art are generally and structurally grouped into single-lens systems and multi-lens systems. However, since spherical aberration in a single-lens system is deteriorated in regions of large current, multi-lens systems are generally employed today.

The multi-lens system comprises a plurality of cylindrical electrodes to which differing electric potentials are applied in order to establish an internal electron optical lens. In this case, the optical properties of the lens vary widely depending on the distribution of the electric potentials applied to the electrodes.

For example, FIG. 1, (*a*) represents three cylindrical electrodes 1,2 and 3. Electrodes 1 and 2 are given electric potential V1 lower than the electric potential V2 of electrode 2. Here, the curve V represents the axial distribution of the space electric potential, V'' the second order function of the distribution of the space electric potential.

According to this arrangement, from electrode 1 to electrode 3 are formed successively regions convergence A, divergence B, convergence A so as to give good characteristics of the spherical aberration. However, since higher electric potential is given to the side of the main focusing lens, it is prone to the danger of internal discharge. On the other hand, if the electric potential V1 of electrodes 1 and 3 is made higher than the electric potential V2 of electrode 2, the danger of internal discharge is prevented but the characteristics of the spherical aberration are deteriorated in the region of large current compared to the case of FIG. 1(*a*).

DISCLOSURE OF THE INVENTION

It is therefore an object of this invention to provide an electron gun for CRTs which resolves the problems stated above by improving the structure of the electrode so as to obtain good characteristics of spherical aberration without the danger of internal discharge.

This invention is characterized by a plurality of the subordinate lenses providing reduction of the divergence region of the third electrode forming the main lens system with the convergence region of the fourth electrode being enlarged and disposition of the sixth electrode inside the fifth electrode so that the sixth electrode forms the subordinate lens to the seventh electrode.

As shown in FIG. 2, the electric potential of the subordinate focusing lens is distributed in the mode of divergence (B)-convergence (A)-divergence (B)-convergence (A)-divergence (B) and inside the main focusing lens is made convergence (A)-divergence (B), so that an electron gun with undeteriorated spherical aberration even in the region of large current and without there being the danger of internal discharge is achieved.

For reference, the diameter of the electron beam focused on the luminescent screen can be obtained with the following equation:

$$D_T: \{(D_X+D_{SA})^2+D_{SC}^2\}^{\frac{1}{2}}$$

$D_X$: diameter of electron beam $D_X$: diameter of electron beam determined by the main lens magnification $D_{SA}$: diverged amount of electron beam resulting from spherical aberration $D_{SC}$: diverged amount of electron beam resulting form mutual repulsion of electrons $D_X$ and $D_{SA}$ in the above equation can be obtained by the following formulas:

$$D_X = M.dx \quad \text{(I)}$$

$$D_{SA} = \tfrac{1}{2}.M.C.s.\ \alpha_o^3 \quad \text{(II)}$$

M: the main lens magnification

Cs: coefficient of spherical aberration dx: size of imaged object

αo: diverging angle of electron beam toward the main lens

From the above formulas, it can be seen that the diameter $D_T$ of the electron beam focused on the luminescent screen is significantly influenced by $D_X$ and $D_{SA}$. Hence, the relation between the electron beam on the luminescent screen and the subordinate lens system is such that focusing performance is enhanced as the size dx of imaged object and the diverging angle αo toward the main lens are reduced. However, as FIG. 2 shows the electric potential distribution, in the first divergence region (B) is abruptly reduced and diverged the velocity of the electron beam, which results in the undesired problem that the diverging angle αo toward the main lens is abruptly increased.

Therefore, according to this invention, the first divergence region (B) is reduced with the next convergence region (A) being enlarged, which causes the diameter of the beam spot not to be increased. Furthermore, in the main lens system of the electron gun establishes three convergence regions (A) and four divergence regions (B), and therefore, the electron beam radiated from the cathode is kept to a minimum diameter during passage through the main lens therethrough, and arrives at the luminescent screen with high resolution, and definite convergence is obtained by the subordinate lens of the sixth electrode even when the focusing voltage varies.

DETAILED DESCRIPTION OF THE INVENTION

For a better understanding of the present invention, reference is made to the following disclosure and appended claims taken in conjunction with the attached drawings of FIG. 3 to FIG. 7.

Figure 1A:
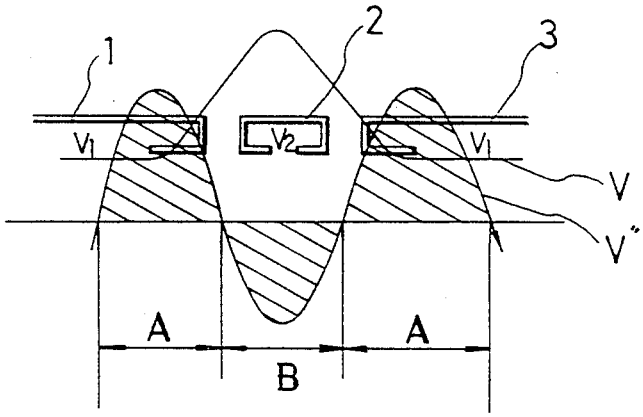
FIG. 1(A) PRIOR ART
FIGS. 1(*a*) and 1(*b*) are schematic diagrams representing the axial distribution of the space electric potential generated from an electron gun of conventional structure and the second order function thereof.
Figure 1B:
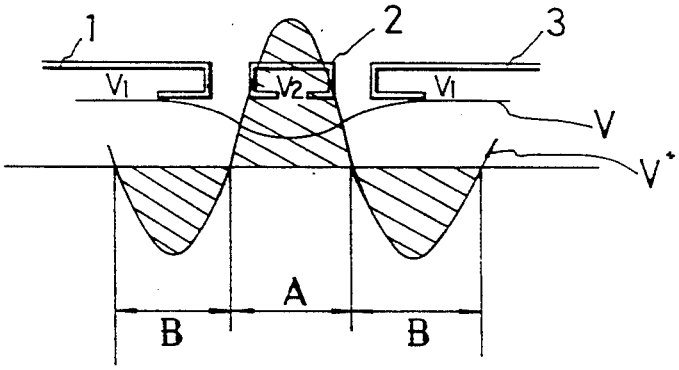
FIG. 1(B) PRIOR ART
Figure 2:
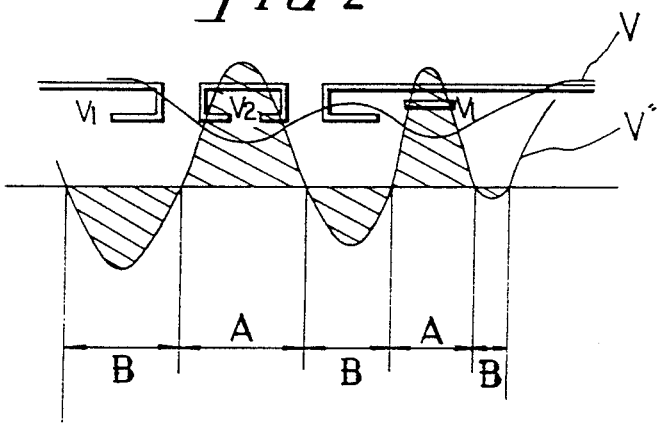
FIG. 2 is a schematic diagram representing the axial distribution of the space electric potential generated from the subordinate focusing lens of an electron gun of this invention.
Figure 3:
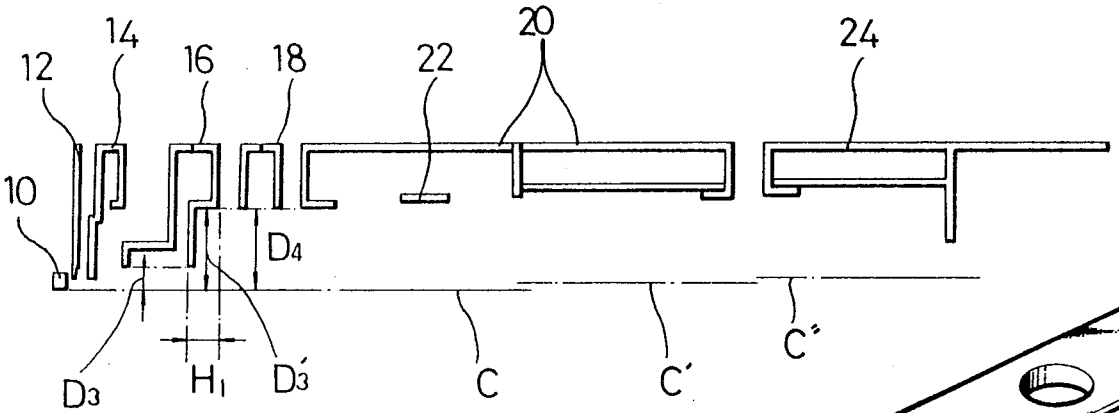
FIG. 3 shows the structure of an electron gun of this invention.

In FIG. 3, reference numeral 10 indicates a cathode that receives an electric potential of 100 to 500 volts. Further, a first electrode 12 is connected with to ground, a second electrode 14 receiving voltage of 400 to 100V, a third electrode 16 voltage of 7 to 10KV, a fourth electrode 18 equipotential with a second electrode 14, the fifth electrode 20 equipotential with a third electrode 16, the sixth electrode 22 equipotential with the second and fourth electrodes 14 and 18, and a seventh electrode 24 equipotential with the luminescent sereen receiving 20 to 30KV.

The rear part of the third electrode 16 is deeply recessed axially to the interval H1, so that there exists a long radius D3′ coinciding with the lens radius D4 of the fourth electrode together with the lens radius D3. With this construction, the divergence region B formed in lens radius D3 of the third electrode 16 is reduced by the interval H1, while the convergence region A is enlarged by the interval H1. By experiment, it has been found that the interval H1 appears to be the best within the range of 0.5 to 0.54 of lens radius D4 of the fourth electrode Since this invention comprises seven electrodes as exemplified above, these being simply sequenced, the length of the electron gun is increased and the inside connection of each electrode is complicated, thereby resulting in another drawback that precision of the assembly is lowered. Therefore, in accordance with this invention, sixth electrode 22 is positioned inside fifth electrode 20.

Figure 4:
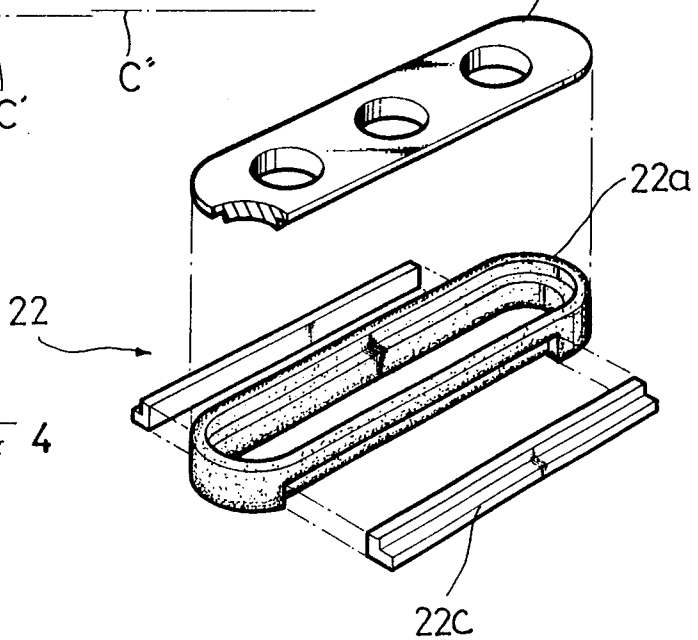
FIG. 4 is an exploded view of the sixth electrode which is the essential part of this invention.

As shown in FIG. 4, the sixth electrode 22 has such a construction that on ceramic insulating member **22*a* is attached electrode body 22*b* having beam passage holes and it can be positioned inside the fifth electrode 20 by means of retainers 22*c*. Further, if the sixth electrode 22 is positioned inside the fifth electrode 20, the center line C of the electron gun forms a straight line up to the sixth electrode 22, against which straight line the fifth electrode 20** is positioned so as to deflect outside the center line C′ of the beam passage hole facing the rear part, forming an asymmetric subordinate lens.

Figure 5:
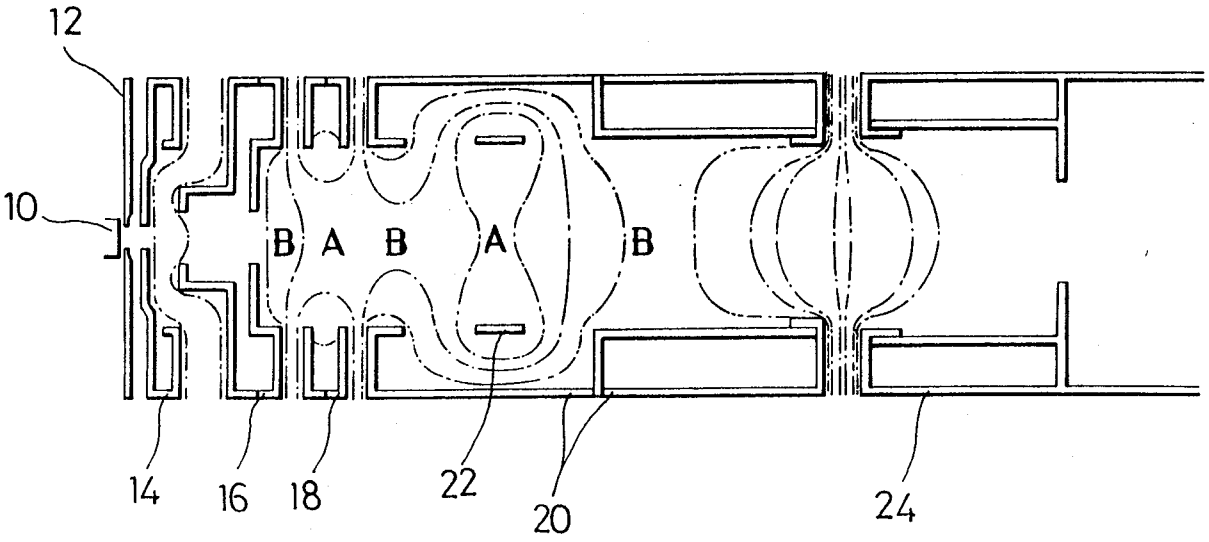
FIG. 5 shows the electric potential distribution of an electron gun of this invention.

In the electron gun of the present invention as described above, the electric potential distribution appearing in the inside thereof is as shown in FIG. 5.

Namely, between the third electrode 16 and the fifth electrode 20 is established the subordinate lens system so that the regions thereof are sequenced in the form of divergence B-convergence A-divergence B-convergence A-divergence B.

Figure 6:
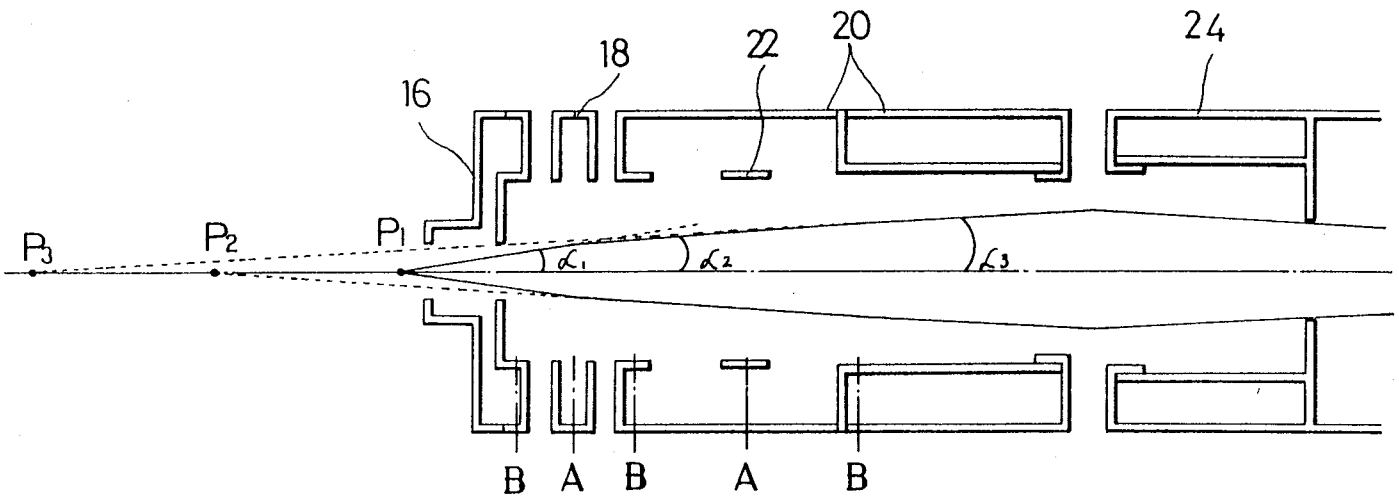
FIG. 6 is a view representing the position of the imaged part forming the main lens system of the present invention.

As shown in FIG. 6, the electron beam diverges when passing.

As shown in FIG. 6, although the electron beam diverges when passing the third electrode 16, the divergence region B is reduced by the interval H1 and therefore, the beam divergence angle $\alpha_1$ is not so great. Furthermore, since the beam converges when passing the fourth electrode 18 and the convergence region A thereof is enlarged, the beam divergence angle $\alpha_2$ at that time becomes smaller than the initial divergence angle $\alpha_1$, thereby effecting the position of the imaged object displaced from P1 to P2. Again, the beam more converges through the convergence region A of the sixth electrode 22, and the divergence angle is more reduced from $\alpha_2$ to $\alpha_3$. Consequently, the position of the imaged object is more displaced to P3, resulting in the longer focus, and therefore the beam diameter is minimized.

Meanwhile, the rear part of the fifth electode 20 is asymmtericaly positioned outwardly of the sixth electrode 22, and the center line C″ is asymmetrically positioned outwardly of the center line C′ of the rear part of the fifth electrode 20. This causes the asymmetric subordinate lens to be established between the rear part of the fifth electrode 20 and the sixth electrode 22, and the main lens between the rear part of the fifth electrode 20 and the seventh electrode 24.

Such a double asymmetrical lens is established so that the convergence varies in mutually opposite directions depending on variation of the focusing voltage.

Figure 7:
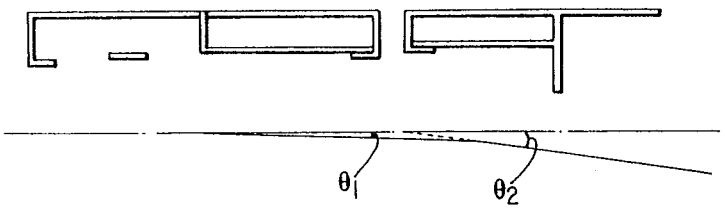
FIG. 7 is a view representing the improvement of the convergence made by the main focusing lens system of this invention.

Therefore, as shown in FIG. 7, the electron beam preliminarily converges when passing the rear part of the fifth electrode 20 from the sixth electrode 22, and if the preliminary convergence angle is $\theta 1$ at that time and the convergence angle by the main lens formed between the fifth electrode 20 and the seventh electrode 24 is $\theta 2$, the beam converges at the convergence angles $\theta 1$ and $\theta 2$ with the normal focusing voltage applied as shown in the drawings, but if the convergence angle $\theta 2$ is increased due to the focusing voltage variation resulting from an external factor, the subordinate lens takes the tendency opposite thereto so as to proportionately reduce the preliminary angle or otherwise, if the convergence angle $\theta 2$ is reduced, then the preliminary convergence angle $\theta 1$ is increased, thereby the convergence being maintained always constant.

As stated above, the present invention essentially resolves the problems appearing in the multi-lens system without the internal discharge, obtaining high resolution by minimizing the beam diameter through correction of the convergence depending on the focusing voltage.

What is claimed is:

1. An electron gun for a multi-lens cathode ray tube system, comprising a cathode for generating an electron beam, a first electrode downstream from said cathode, a second electrode downstream from said first electrode, a third electrode downstream from said second electrode, a fourth electrode downstream from said third electrode, a fifth electrode downstream from said fourth elctrode, a sixth electrode downstream from said fourth electrode and a seventh electrode downstream from said fifth and sixth electrodes each of said electrodes defining a path for the passage of said electron beam, wherein the third electrode has a rear part at the downstream end of said third electrode and adjacent to said fourth electrode and a front part at the opposite end of said third electrode, said front and rear parts of said third electrode forming a front and rear lens radius, said rear lens radius being deeply recessed axially by an interval defined by said rear part of said third electrode and proportioned to provide a rear lens radius larger than said front lens radius and equaling a lens radius associated with the fourth electrode, and the sixth electrode being spaced from and surrounded by the fifth electrode, thereby providing a main lens system forming regions in the form divergence-convergence-divergence-convergence-divergence-convergence-divergence, said sixth electrode forming a subordinate lens within a main lens structure, said main lens structure comprising the fifth electrode and the seventh electrode, said main lens structure forming a main lens between said fifth and seventh electrodes.

2. An electron gun as in claim 1, wherein said interval defined by the rear part of the third electrode is within the range 0.5 to 0.54 of the rear lens radius.

3. An electron gun as in claim 1, wherein said sixth electrode comprises an insulating member, an electrode body mounted on said insulating member, and retainers secured to said insulating member.

4. An electron gun for a multi-lens cathode ray tube system of a type comprising a main lens for converging an electron beam and a subordinate lens for preliminary converging of said electron beam before it enters said main lens wherein said electron gun comprises an electron source and a multi-lens system which is formed by an array of electrodes comprising first, second, third, fourth, fifth and seventh electrodes, each of said electrodes being progressively further downstream from said electron source, a sixth electrode being spaced from and surrounded by said fifth electrode, each of said electrodes allowing passage of an electron beam to the next electrode and beyond, said third electrode comprising rearward and forward electrode elements downstream and upstream from said electron source, respectively, said rearward electrode element being deeply recesed to form a large radius, said large radius being equal to the radius of a beam passing aperture formed by said fourth electrode and said forward element defining a smaller radius, an insulating body inserted into said sixth electrode and positioned inside of an upstream portion of said fifth electrode and means for applying a first voltage to said second, fourth and sixth electrodes and second voltage means for applying a second voltage to said third and fifth electrodes, said first voltage being lower than said second voltage.

5. An electron gun as in claim 4, wherein said insulating body comprises an electrode insulating case surrounding an outer surface of said sixth electrode and a retainer supporting said electrode insulating case to the inner surface of said fifth electrode.

* * * * *